US007069817B2

(12) United States Patent
Wesch, Jr.

(10) Patent No.: US 7,069,817 B2
(45) Date of Patent: Jul. 4, 2006

(54) POWER TONGS

(76) Inventor: William E. Wesch, Jr., 6401 Eastridge Rd. #808, Odessa, TX (US) 79762

( * ) Notice: Subject to any disclaimer, the term of this patent is extended or adjusted under 35 U.S.C. 154(b) by 0 days.

(21) Appl. No.: 10/967,897

(22) Filed: Oct. 18, 2004

(65) Prior Publication Data

US 2006/0081091 A1 Apr. 20, 2006

(51) Int. Cl.
*B25B 17/00* (2006.01)

(52) U.S. Cl. ..... 81/57.16; 81/57.15; 81/57.2; 81/57.33; 81/57.34

(58) Field of Classification Search ..... 81/57.15, 81/57.16, 57.2, 57.33, 57.34
See application file for complete search history.

(56) References Cited

U.S. PATENT DOCUMENTS 2,650,070 A 8/1953 Lundeen
4,281,535 A 8/1981 Wesch, Jr.
RE31,993 E 10/1985 Wesch, Jr.
5,172,613 A * 12/1992 Wesch, Jr. ..... 81/57.33
5,207,128 A * 5/1993 Albright ..... 81/57.18
5,542,318 A 8/1996 Wesch, Jr.
6,116,118 A 9/2000 Wesch, Jr.
6,250,070 B1 6/2001 Kreiner et al.
6,446,524 B1 * 9/2002 Gravouia ..... 74/459.5
6,761,090 B1 * 7/2004 Dagenais et al. ..... 81/57.18

* cited by examiner

*Primary Examiner*—Lee D. Wilson
*Assistant Examiner*—Shantese McDonald
(74) *Attorney, Agent, or Firm*—Marlin R. Smith

(57) ABSTRACT

Damage to pipe resulting from non-uniform application of gripping forces is minimized by modified power tongs employing pivoting jaws which automatically adjust to the circumference of the pipe. The pivoting jaws pivot about mounting pins which pass through an elongated aperture in the jaw. The aperture is elongated in a direction which allows the arcuate pipe-gripping surface on the jaw to align itself concentric with the outer surface of the pipe so that the gripping force applied by the jaw is uniformly distributed over the arcuate pipe-gripping surface of the jaw.

35 Claims, 8 Drawing Sheets

POWER TONGS

This invention relates to power tongs and back-up tools which have improved apparatus for gripping tubular members such as pipe and the like. More particularly, it relates to improved gripping mechanisms in power tongs and the like which minimize deformation and damage to tubular members by gripping surfaces of jaws which gouge, crimp or slide along the surface of the tubular member.

Power tongs are devices used to secure together ("make-up") and detach ("break-out") threaded ends of two adjacent tubular products such as pipe sections by gripping, applying torque to and rotating one of the sections. U.S. Pat. No. Re 31,993 (incorporated herein by reference for all purposes) issued on Oct. 1, 1985 as a reissue of U.S. Pat. No. 4,281,535 and describes means to accomplish the task of making and breaking the threaded joints of such tubular members. Other devices known as back-ups or back-up tools are often used in conjunction with such tongs to grip and hold the other of the two adjacent sections of pipe against rotation.

Tubular members such as drill string pipe must be screwed and torqued together without damage thereto so that stress and corrosion concentrations will not occur in tears and gouges caused by the tong and/or back-up teeth. In addition, to maintain integrity of the threaded connection it is desirable to reduce deformation of the pipe by the power tongs and back-ups near the location of the threads, thus allowing more compatible meshing of the threads and reducing frictional wear. Moreover, deformation of internally lined pipe by the gripping mechanism can, and often does, cause fracture and/or delamination of the lining from the internal surface of the pipe, thus destroying the protection of the pipe intended to be afforded by such internal linings.

Gouging and tearing of pipe is caused in some instances by undesirable concentration of the gripping force applied by the gripping mechanism. For example, insufficient contact area between gripping teeth and the pipe (or inadequate contact by one or more of a number of gripping members which engage the pipe) can cause the gripping force to be concentrated with and applied by the remaining members. Still further, the gripping surface presented to the pipe may not conform in radius to the outer diameter of the pipe, causing uneven distribution of the gripping force across the surface of the pipe and concentrations at drastically reduced areas of contact between the pipe and the griping mechanism. Typically, this damages the pipe because the pressure applied to the pipe is concentrated in the relatively small area of contact between the gripping mechanism and pipe instead of being spread over the face of the gripping mechanism.

In conventional tongs, pressure applied by the gripping jaws is not distributed evenly around the pipe but is applied to small areas spaced around the perimeter of the pipe. Typically, two (2) jaws are employed, one of which (referred to as the "inactive" or "reactive" jaw) usually carries two (2) gripping surfaces fixedly spaced with respect to each other and the outer surface of the pipe. The other jaw (referred to as the "active" jaw) is pivotally mounted so that its gripping surface may be forced toward the outer surface of the pipe in a direction opposing the inactive jaw to securely grip the pipe between the gripping surfaces of the active jaw and the inactive jaw. The power tong apparatus described in U.S. Pat. No. 5,172,613 entitled "Power Tongs With Improved Gripping Means" is typical of such conventional tongs. Such conventional tongs are usually constructed so that the inactive jaws define a pipe cavity with an entry throat and the active jaw pivots toward and away from the cavity to permit a pipe section to enter the cavity through the throat. Accordingly, if the pipe is not perfectly circular and/or has a greater or lesser diameter than the design diameter of the tongs, the forces applied to the pipe by the gripping surfaces of the jaws will not be evenly or uniformly distributed. When such gripping forces are not uniformly distributed, the pipe may be gouged, crushed or otherwise damaged by the tongs. Furthermore, the jaws of most tongs only grip the pipe when the tong is rotated in one direction about the axis of the pipe. To use the tong to rotate the pipe in the opposite direction, the placement of the tong must be reversed and/or the jaws must be replaced.

In accordance with the present invention, power tong apparatus is provided in which the gripping forces applied to the pipe by the gripping surfaces of the jaws will be relatively uniformly distributed around the arcuate face of the gripping surface. Distribution of gripping force is provided by mounting at least one jaw on a pivot pin in such a manner that the spatial relationship between the arcuate gripping surface of the jaw and the arcuate surface of the pipe may vary to accommodate various sizes and shapes of pipe. The gripping mechanism of the invention may also be designed to operate equally effectively when rotating the pipe in either direction. Accordingly, tongs employing the gripping mechanisms of the invention may be used to make or break a joint without repositioning or reconfiguring the jaws in the tong. Moreover, damage caused by applying non-uniform gripping forces to the pipe is virtually eliminated.

Other features and advantages of the invention will become more readily understood from the following detailed description taken in connection with the appended claims and attached drawing in which:

Figure 1:
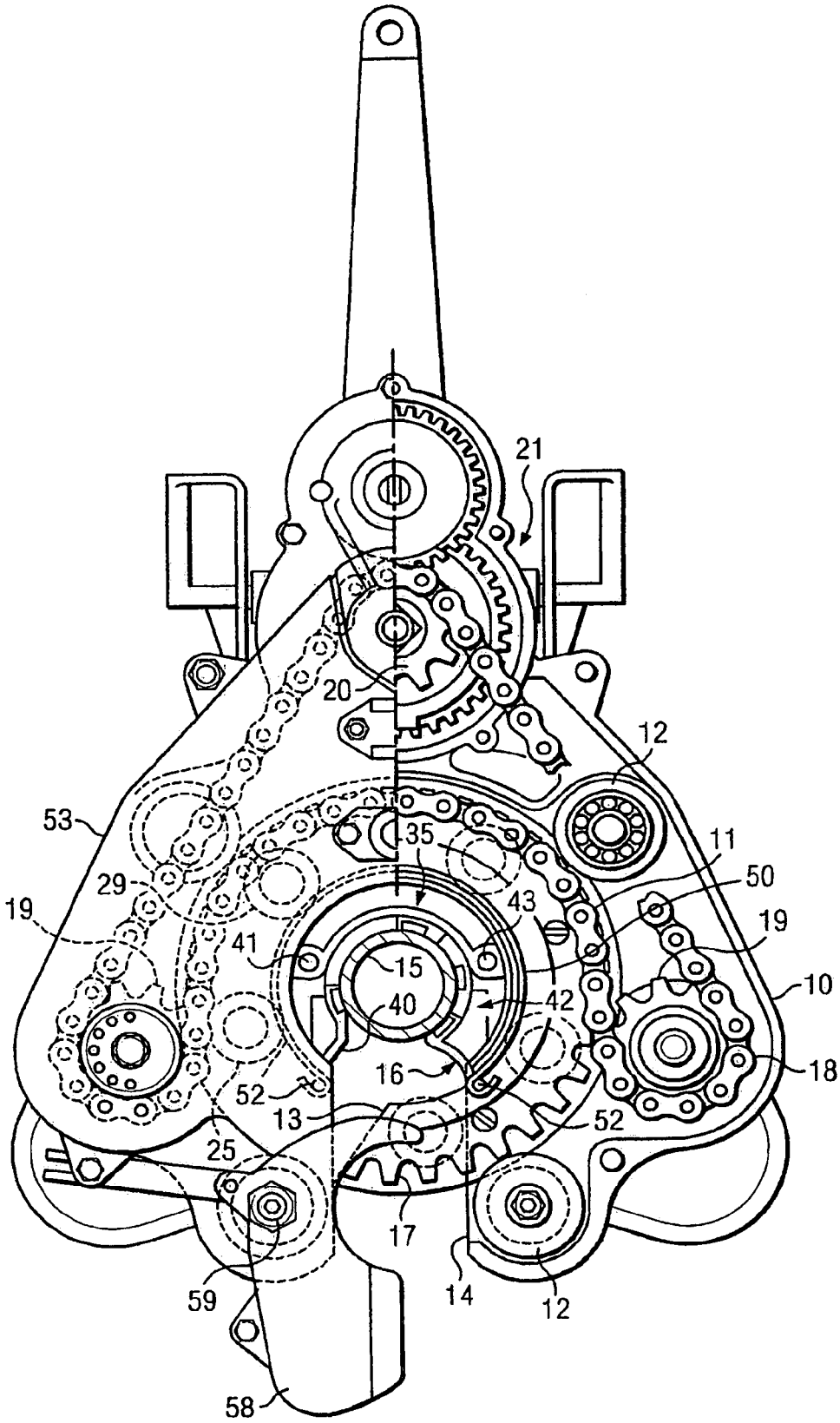
FIG. 1 is a top plan view, partially broken away, showing a power tong employing one embodiment of the invention.
Figure 2:
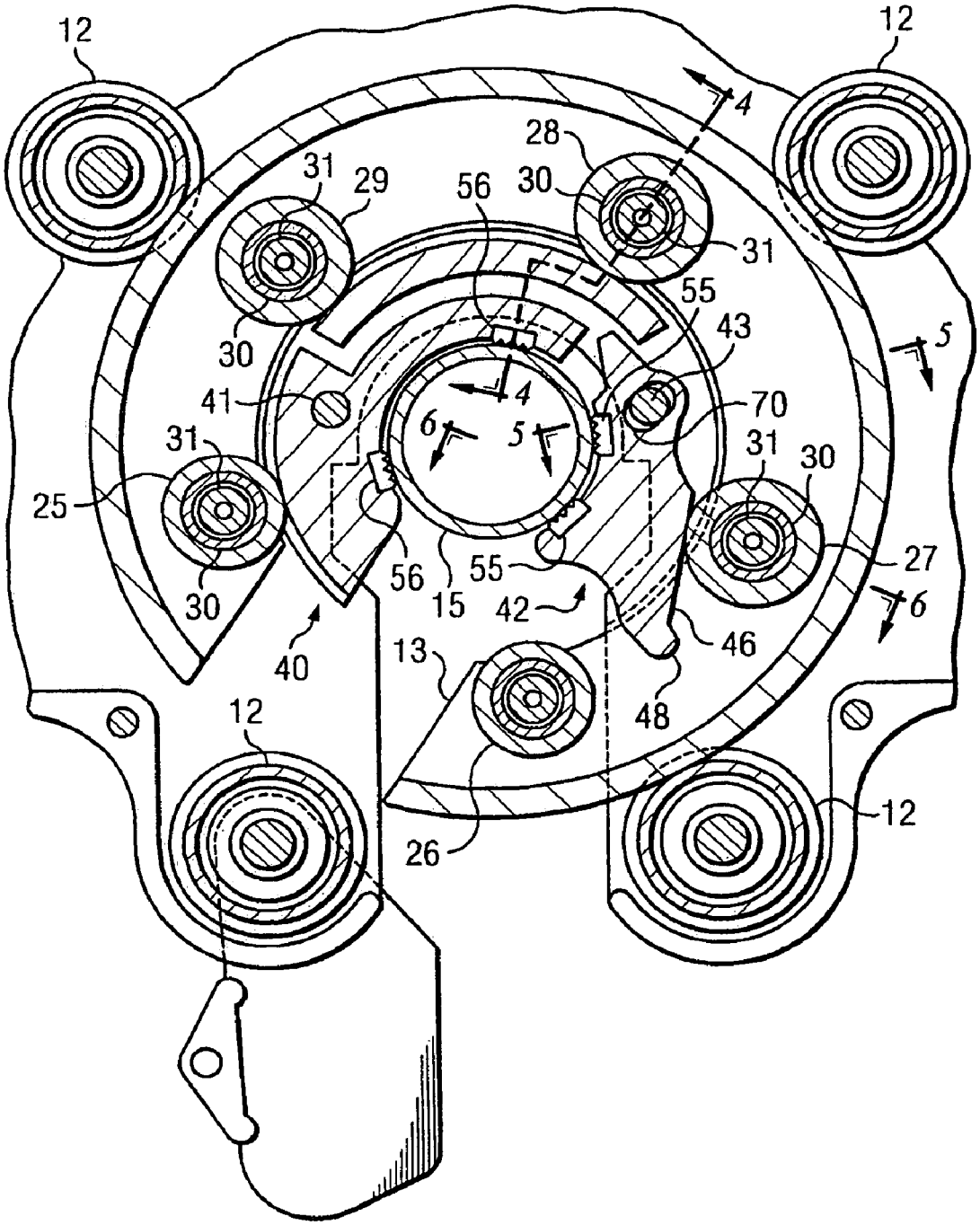
FIG. 2 is a sectional plan view of the pipe-gripping mechanism of the embodiment of FIG. 1 showing the jaws in operative pipe-gripping position.
Figure 3:
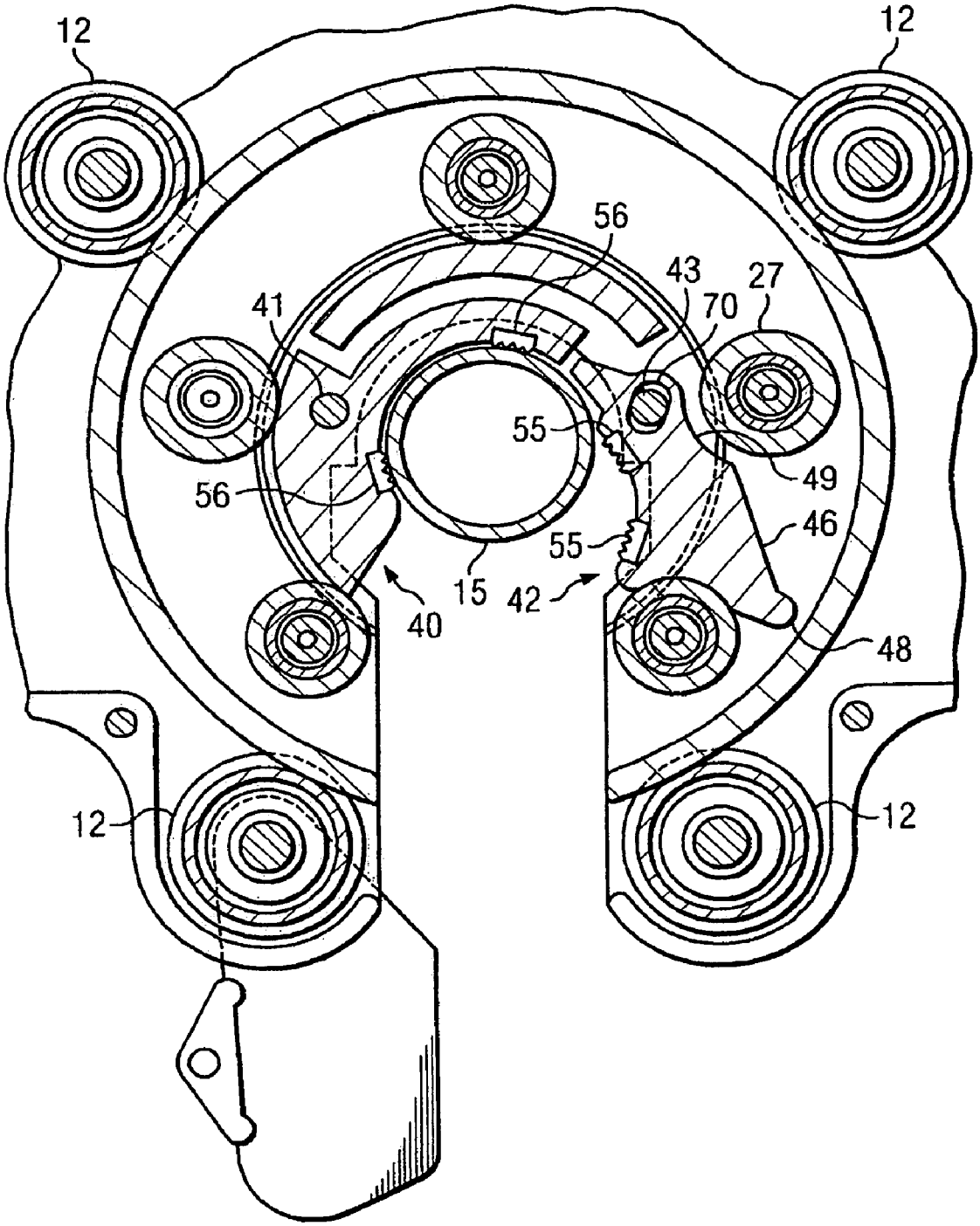
FIG. 3 is a sectional plan view similar to FIG. 2 showing the pivoted jaw in retracted position.
Figure 4:
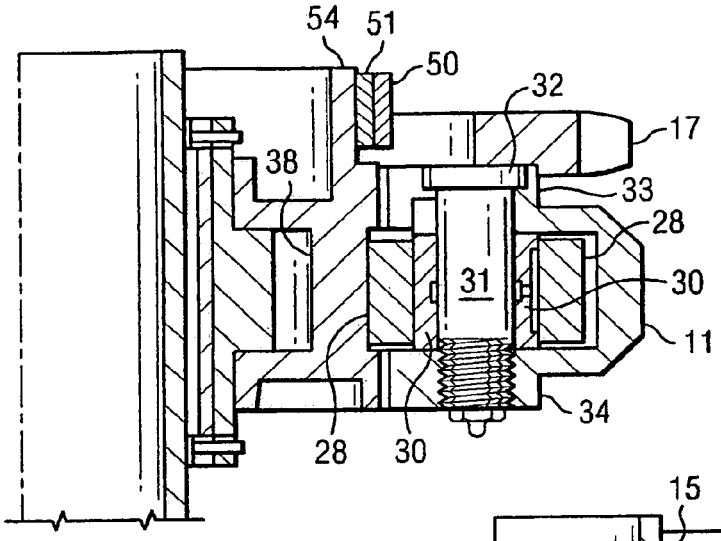
Figure 5:
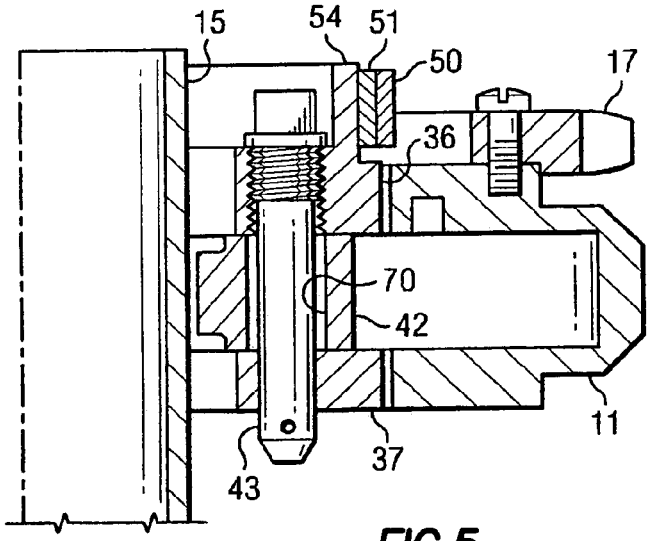
Figure 6:
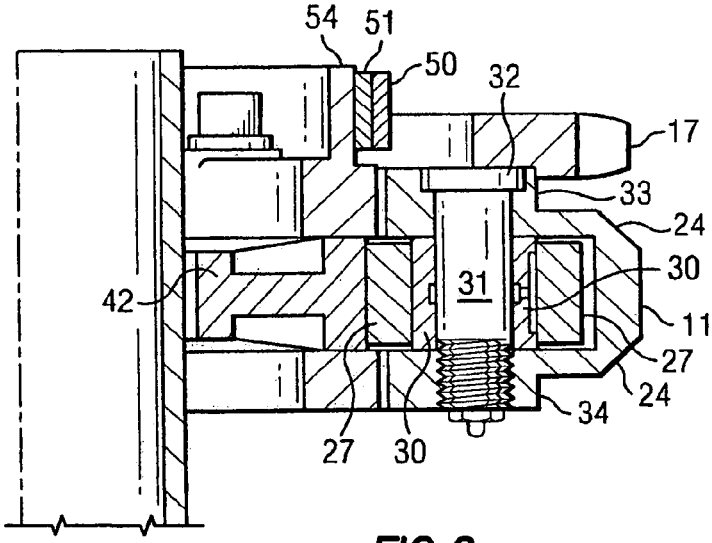
Figure 7:
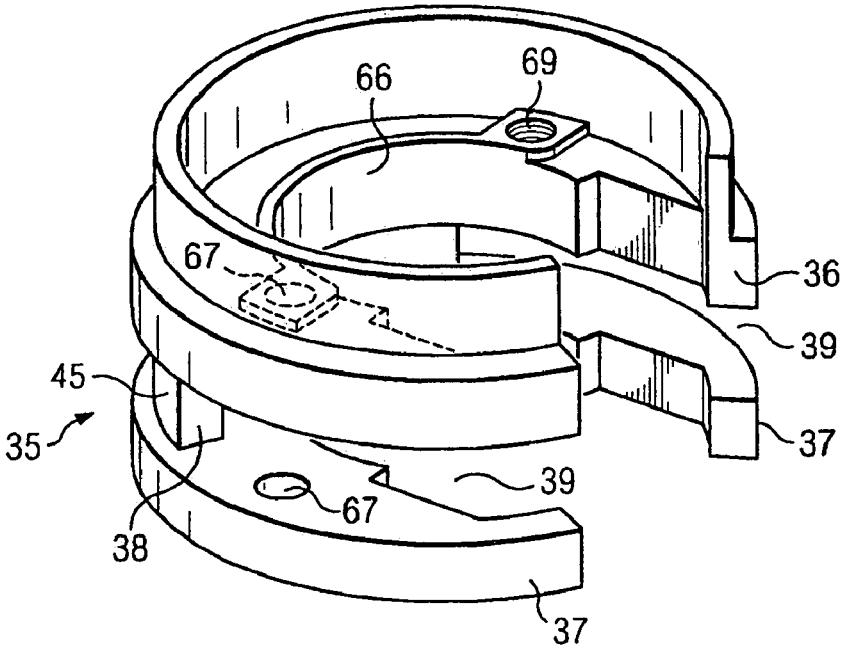
Figure 9:
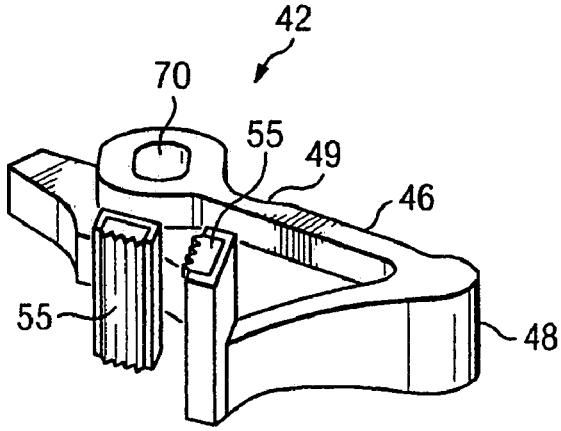
Figure 8:
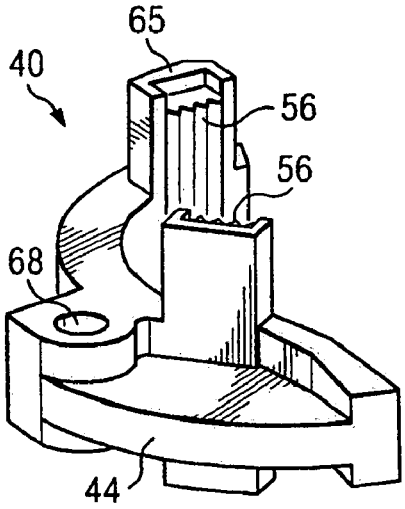
Figure 10:
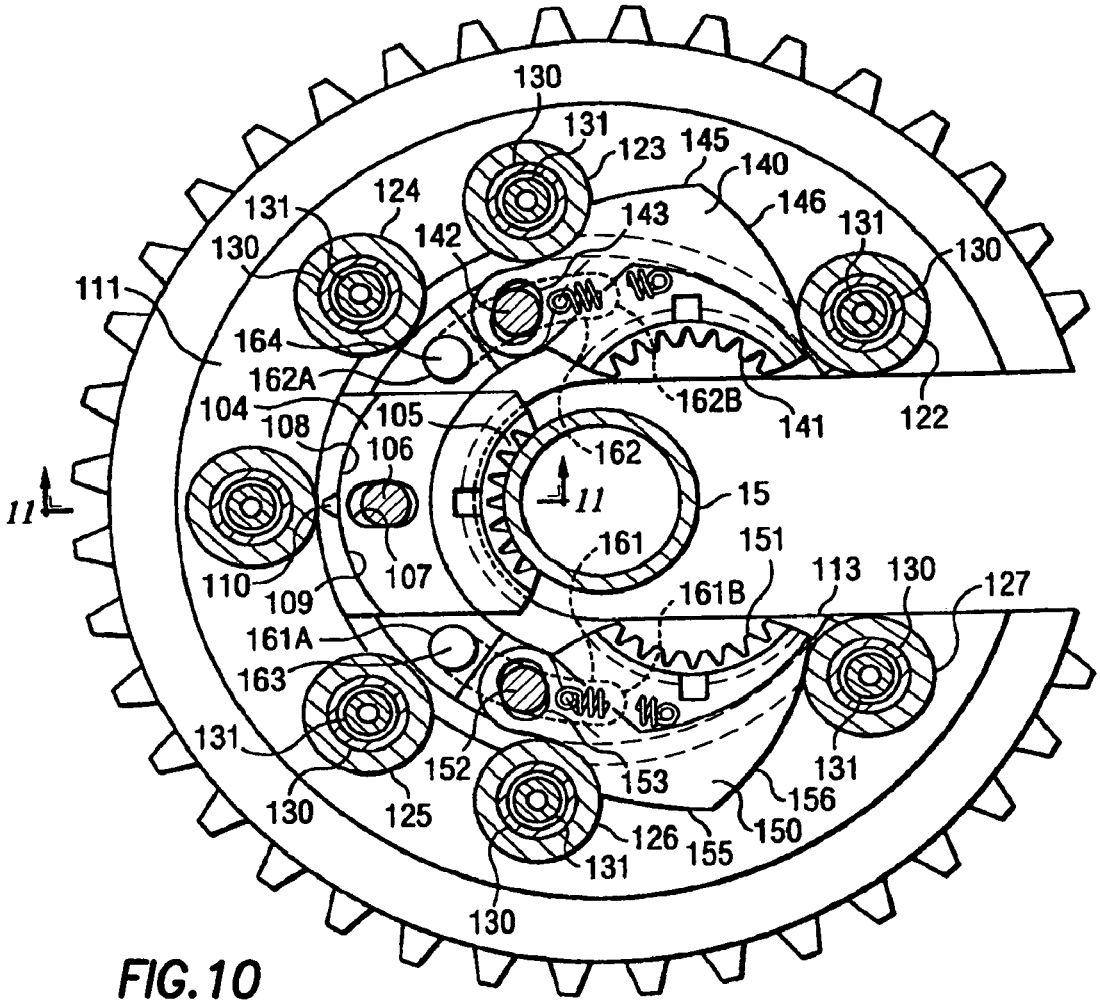
Figure 11:
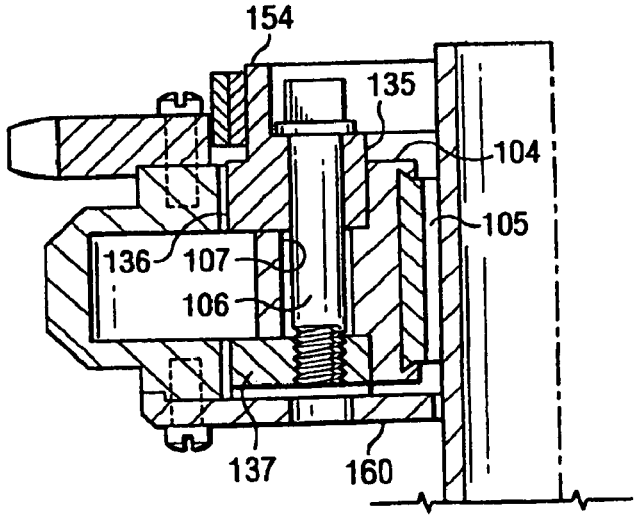
Figure 12:
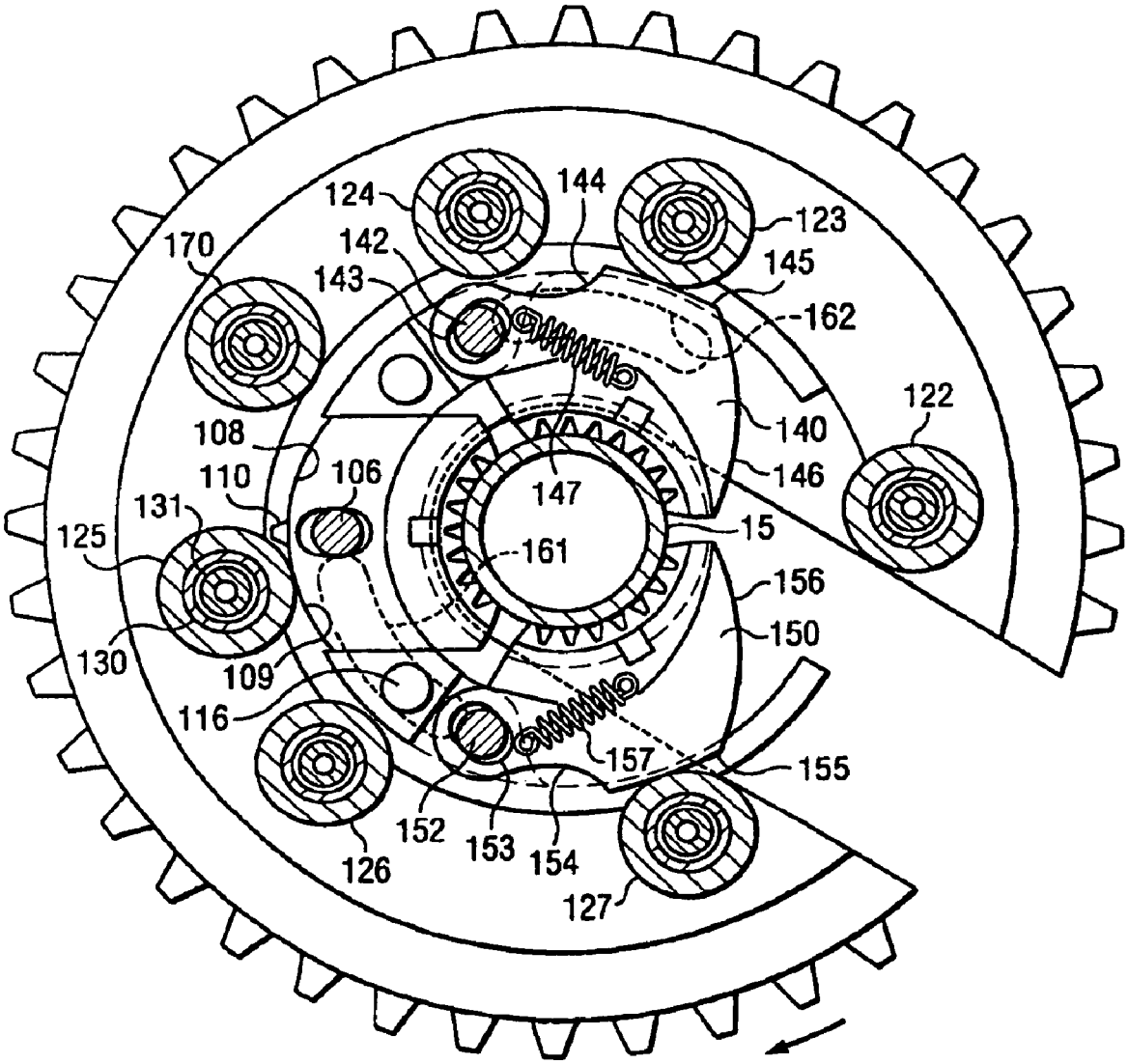
Figure 13:
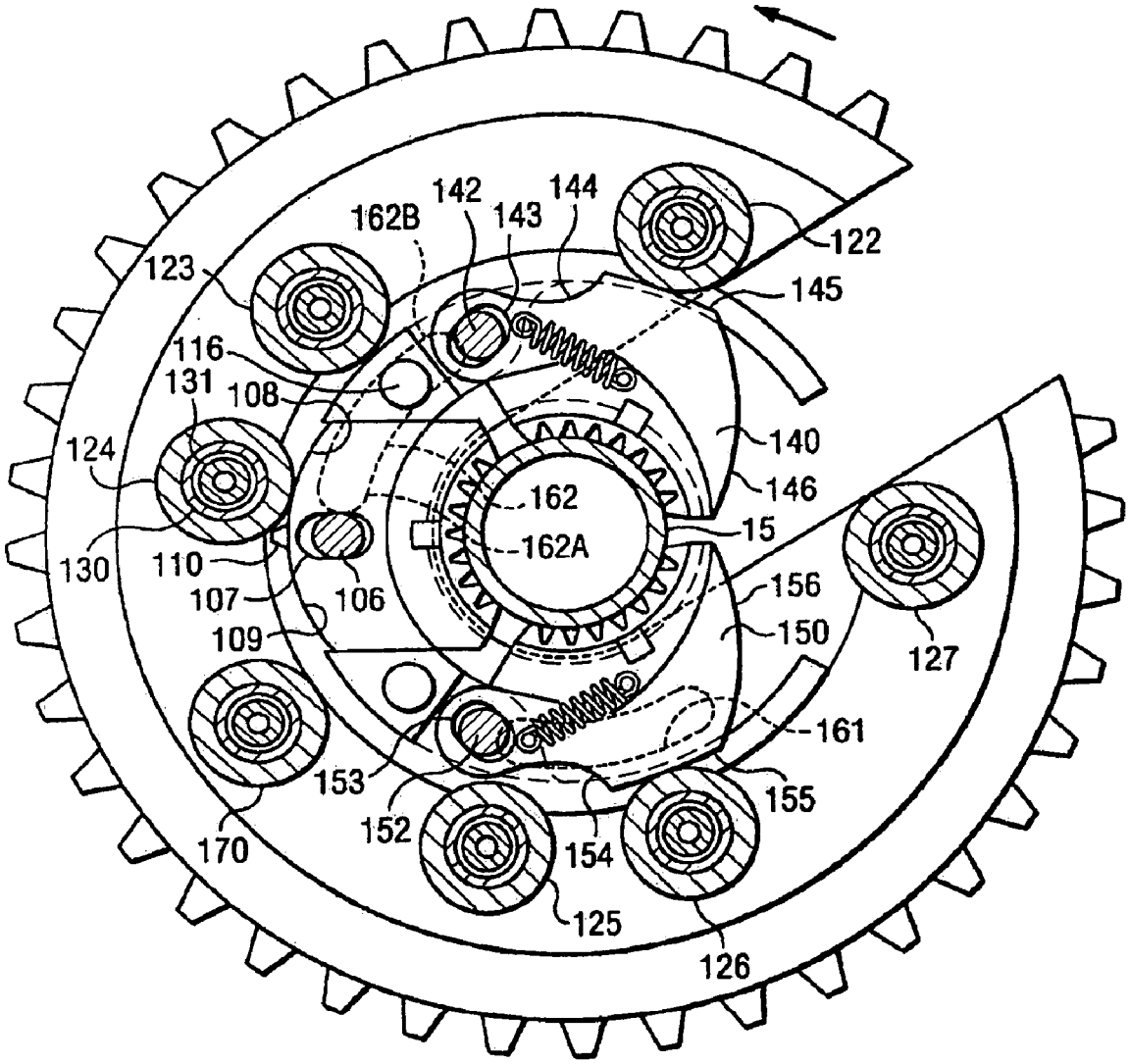
Figure 14:
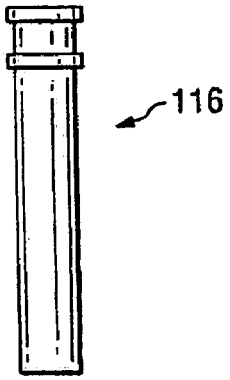

FIGS. 4, 5 and 6 are partial sectional elevational views of the pipe-gripping mechanism of FIG. 1 taken through lines 4—4, 5—5 and 6—6, respectively, shown in FIG. 2.;

FIG. 7 is a perspective view of the inner ring jaw carrier in the apparatus of FIG. 1;

FIG. 8 is a perspective view of the inactive jaw in the apparatus shown in FIG. 1;

FIG. 9 is a perspective view of the pivoting active jaw;

FIG. 10 is a sectional plan view of an alternative embodiment of gripping mechanism employing the principles of the invention showing the jaws in the open position;

FIG. 11 is a fragmentary partial sectional plan view of the gripping mechanism of FIG. 10 taken through line 11—11;

FIG. 12 is a view similar to FIG. 10 showing the jaws in the closed position when the outer ring is rotated clockwise;

FIG. 13 is a view similar to FIG. 10 showing the jaws in the closed position when the outer ring is rotated counter-clockwise; and FIG. 14 is a perspective view of one embodiment of a limit pin used in the mechanism of FIGS. 10–13 to control rotation of the inner ring with respect to the outer ring in accordance with the invention.

The drawing is incorporated into and forms part of the specification to illustrate exemplary embodiments of the invention. For clarity of illustration, like reference numerals designate corresponding elements throughout the drawing. It will be recognized that the principles of the invention may be utilized and embodied in many and various forms. In order to demonstrate these principles, the invention is described herein by reference to specific preferred embodiments. The invention, however, is not limited to the specific forms illustrated and described in detail.

As used herein, terms such as "pipe," "tubulars," tubular goods," "tubing" and the like are used interchangeably to refer to an axially elongated cylindrical body having a substantially circular outer periphery. Relative, directional and spatial orientation terms such as "inner," "outer," "vertical," "horizontal," "upper," "lower," laterally," etc., are used to refer to and describe apparatus of the invention with respect to the axis of a substantially vertically oriented pipe and/or with respect to tongs positioned on a substantially vertically oriented pipe to rotate the pipe about its vertical axis.

The power tong illustrated in the drawing includes a frame 10 which rotatably supports an integral ring 11 by means of a plurality of rollers 12. The ring 11 (sometimes referred to herein as the outer ring) has a side opening 13 which may be aligned with a side opening 14 in the frame 10. When the openings 13 and 14 are aligned, the tong may be applied laterally to a pipe 15, the pipe entering the openings 13, 14 and passing to a central position with respect to the outer ring 11. The pipe-gripping mechanism (generally designated 16) is positioned coaxially of the outer ring 11.

A main sprocket 17 secured to the outer ring 11 is driven by an endless chain 18 which passes drive sprocket 20 and over idler sprockets 19 mounted on the frame 10. Drive sprocket 20 is driven by a transmission generally designated at 21 which receives power from any convenient source such as, for example, an air driven, electric or hydraulic motor or the like (not shown). The general construction of such power tong devices, with the exception of the pipe-gripping mechanism 16, may be substantially the same, for example, as that shown in U.S. Pat. No. 2,650,070.

In the tong illustrated, outer ring 11 has conical surfaces 24 (see FIG. 6) which are received by the grooved supporting rollers 12. The ring 11 is thus rotatably supported on the frame 10 but restrained against axial movement. As illustrated in FIG. 2 the pipe-gripping mechanism 16 is rotatably supported on outer ring 11 by rollers 25, 26, 27, 28 and 29, each of which is mounted on a bushing 30 encircling a mounting pin 31. The head 32 of each pin 31 is received in upper flange 33 of outer ring 11. The lower end of each pin 31 is threaded into the lower flange 34.

The pipe-gripping mechanism 16 supported on rollers 25, 26, 27, 28 and 29 includes an inner ring or jaw carrier 35 (see FIG. 7) having upper and lower arcuate flanges 36 and 37 connected by an arcuate web 38. Web 38 extends for a shorter distance circumferentially than the flanges 36 and 37 so that slots 39 are formed between flanges 36 and 37 at the ends of the web 38. An inactive jaw 40 (see FIGS. 2–8) is secured to jaw carrier 35 by pin 41 which passes through aligned apertures 67 in jaw carrier 35 and aperture 68 in jaw 40. Active jaw 42 is pivotally supported on inner ring jaw carrier 35 with a pivot pin 43 which passes through aligned apertures 69 in carrier 35 and elongated aperture 70 in active jaw 42. The jaws 40 and 42 are thus each mounted within one of the lateral slots 39 formed by flanges 36 and 37 on inner ring jaw carrier 35. An arcuate surface 65 on the back side of inactive jaw 40 fits the curved surface 66 within carrier 35. The periphery of each of rollers 25–29 extends between flanges 36 and 37 to restrain inner ring jaw carrier 35 against axial movement. These rollers also contact the arcuate surface 44 of jaw 40, the arcuate surface 45 of web 38, and the cam surface 46 on active jaw 42 to maintain the pipe-gripping assembly 16 centrally positioned within outer ring 11.

As illustrated in FIG. 9, a cam surface 46 on active jaw 42 extends between an outwardly directed retracting finger 48 and an arcuate-shaped recess 49. Cam surface 46 is engaged by roller 27 when outer ring 11 is rotated with respect to inner ring jaw carrier 35. In the embodiment illustrated, outer ring 11 is rotated with respect to jaw carrier 35 by drawing endless chain 18 around sprocket 17.

As illustrated in FIGS. 4, 5 and 6, a friction band 50 having suitable lining 51 is fixed to stationary pins 52 carried by the frame cover 53 (see FIG. 1). Stationary band 50 encircles a portion of an upright rim 54 on upper flange 36 of jaw carrier 35. Stationary band 50 and lining 51 thus impose a friction drag on jaw carrier 35 so that the inner ring jaw carrier 35 is normally held stationary at the start of rotational movement of outer ring 11. When the periphery of roller 27 engages cam surface 46, active jaw 42 swings inwardly to engage the pipe 15.

Jaws 40 and 42 may be provided with hardened inserts or dies 55 and 56 of conventional type for engagement with the outer surface of the pipe. Although the pipe-gripping surfaces of the jaws illustrated each employ two (2) circumferentially spaced apart dies, it will be readily appreciated that all or any portion of the arcuate faces of the jaws may be provided with inserts which contact and grip the pipe surface. When dies 55 on active jaw 42 and dies 56 on inactive jaw 40 are urged into contact with the pipe 15, the jaws and inner ring jaw carrier 35 are caused to rotate in unison with outer ring 11, thereby rotating pipe 15 about its vertical axis.

It will be observed that the gripping force applied to pipe 15 is developed by engagement of roller 27 with cam surface 46 on active jaw 42. The arcuate cam surface 46 may be shaped as desired in order to apply gripping forces on the pipe 15 without applying excessive compressive forces which might permanently crimp the pipe. The ratio of torque applied to the outer ring 11 to maximum squeezing force applied to the pipe 15 may be set to any desired value by varying the shape of cam surface 46. The force distribution (the gripping force in terms of force/area) is determined by the surface area of the dies applied to the surface of the pipe.

As roller 27 moves away from pivot pin 43, the moment arm of the force exerted on active jaw 42 increases, but the magnitude of the force decreases because of the change in wedge angle of camming surface 46. Hence, the torque applied to active jaw 42 increases and the crushing force applied by the die 55 to the pipe 15 decreases correspondingly.

It will be observed that the arcuate gripping surface of jaw 42 is spaced from the pivot pin 43 so that jaw 42 comprises an arm which pivots at one end to move the opposite end through an arc toward the pipe 15. In order for the arcuate gripping face of the jaw 42 to be concentric with the surface of the pipe 15 when the jaw is in the gripping position, the jaw must pivot to a position in which the arcuate gripping surface is precisely concentric with the outer surface of the pipe. However, if the pipe is smaller (or larger) in diameter than the design diameter of the jaw, or if the pipe is deformed from the desired circular circumference, a jaw which pivots about a fixed point will engage the pipe non-uniformly. Either the outermost edge or the innermost edge of the arcuate pipe-gripping surface will engage the pipe first. Accordingly, as additional pressure is exerted on the jaw, the gripping force will be applied non-uniformly.

To avoid the problem of non-uniformly applied gripping force, aperture 70 is elongated in a direction which is within the 90° angular segment defined by a line extending radially with respect to the arc defined by the gripping face of the jaw at the point where such radial line crosses a line tangential with the said arc. For purposes of this disclosure, any direction within that 90° angle is defined as a "less than tangential direction." When the elongated slot 70 extends in a less than tangential direction as defined, the pivot end of jaw 42 may move in that direction when the arcuate pipe-gripping surface contacts the pipe. The pipe-gripping surface will thus automatically self-adjust so that the pipe-gripping surface is concentric with the pipe surface and the gripping force applied by the jaw 42 will be relatively evenly distributed over the surface area of the pipe-gripping surface.

The pipe-gripping mechanism 16 may be opened by simply reversing the direction of rotation of the outer ring 11. As shown in FIG. 2, when outer ring 11 is moved counterclockwise roller 27 moves toward pin 43 and roller 26 approaches the retracting finger 48. The friction band 50 holds the inner ring jaw carrier 35 stationary while roller 26 engages retracting finger 48 and moves active jaw 42 from the operative position shown in FIG. 2 to the inoperative position shown in FIG. 3. Arcuate recess 49 in the surface of active jaw 42 provides clearance for roller 27 so that the jaw may be swung to its fully retracted position. Rotation of outer ring 11 in the counterclockwise direction is continued until its opening 13 is aligned with opening 14 in frame 10. The tong apparatus may then be withdrawn laterally as the pipe moves through the openings 13 and 14. A guard 58 pivotally mounted on pin 59 normally closes the entrance to opening 14 when the tong is in an operative position about the pipe 15.

An alternative embodiment of the pipe-gripping mechanism 16 is illustrated in FIGS. 10–13. In this embodiment an outer ring 111 is supported in frame 10 by a plurality of rollers 12 as described hereinabove with respect to outer ring 11 in the embodiment illustrated in FIGS. 1–9. In the embodiment of FIGS. 10–13, the pipe-gripping mechanism 16 is rotatably supported in outer ring 111 by rollers 122, 123, 124, 125, 126 and 127, each of which is mounted in a bushing 130 encircling a mounting pin 131 in the same manner as described hereinabove with respect to the embodiment illustrated in FIGS. 1–9. In this embodiment, however, the active jaw 104 is retained on inner ring or jaw carrier 135 by jaw pin 106 in slot 107. Jaw pin 106 extends between upper flange 136 and lower flange 137 on inner ring 135 and through aperture 107 in jaw 104. Jaw 104 is mounted diametrically opposite opening 113 in inner ring 135. Aperture 107 is elongated to form a slot which extends toward the vertical axis of pipe 15 so that jaw 104 (and thus the arcuate pipe-gripping surface 105) may be moved laterally toward and away from the pipe 15.

The outer end of active jaw 104 opposite pipe-gripping surface 105 is curved to form camming surfaces 108 and 109 which extend from opposite side edges of the active jaw 104 toward an apex at the axial centerline extending from the pipe-gripping surface to the opposite end of the jaw 104. The camming surfaces 108 and 109 converge at the apex which carries a boss or ridge 110 centrally located and extending outwardly from the end of jaw 104 opposite pipe-gripping surface 105.

Rollers 124 and 125 are mounted on outer ring 111 on opposite sides of jaw 104 so that when outer ring 111 is rotated clockwise (as shown in FIG. 12) with respect to inner ring 135, roller 125 engages cam surface 109 and urges active jaw 104 toward pipe 15. Similarly, when outer ring 111 is rotated in the opposite (counterclockwise) direction (as shown in FIG. 13), roller 124 engages cam surface 108 and urges jaw 104 toward pipe 15.

Side jaws 140 and 150 are mounted on inner ring 135 on opposite sides of opening 113. Side jaw 140 has an arcuate pipe-gripping surface 141 aligned to engage pipe 15 when jaw 140 pivots about mounting pin 142 extending through aperture 143 in side jaw 140. Likewise, side jaw 150 has an arcuate pipe-engaging surface 151 aligned to engage pipe 15 when jaw 150 pivots about mounting pin 152 extending through aperture 153 in side jaw 150. Apertures 143 and 153, like aperture 70, are elongated to form slots which extend in a less than tangential direction as defined above.

The back side edge of jaw 140 (the side edge substantially opposite the pipe-engaging surface 141) defines three (3) distinct camming surfaces. The outer surface extending from the pivot end of jaw 140 toward the free end thereof defines a concave camming surface 144. The back side of the free end defines a steep wedge or convex surface 146. The intermediate surface 145 defines an arcuate surface substantially concentric with the pipe-engaging surface 141. Similarly, the back side of jaw 150 (the side substantially opposite the pipe-engaging surface 151) defines three (3) distinct camming surfaces. The outer surface extending from the pivot end of jaw 150 toward the free end thereof defines a concave camming surface 154. The back side of the free end defines a steep wedge or convex surface 156. The intermediate surface 155 defines an arcuate surface substantially concentric with the pipe-engaging surface 151.

As illustrated in FIG. 12, a spring 147 attached between the free end of side jaw 140 and inner ring 135 holds the jaw 140 in the open position illustrated in FIG. 10. Likewise, spring 157 attached between the free end of side jaw 150 and inner ring 135 holds side jaw 150 in the open position illustrated in FIG. 10. However, when outer ring 111 is rotated clockwise (as illustrated in FIG. 12) roller 123 moves along camming surface 144, moving side jaw 140 to the closed position. Simultaneously, roller 127 moves along camming surface 156 to close jaw 150. As outer ring 111 rotates further clockwise, roller 123 rides on arcuate camming surface 145 and roller 127 rides on arcuate camming surface 155 to maintain side jaws 140 and 150 closed with the pipe-engaging surfaces 141, 151 in contact with the outer surface of pipe 15.

When side jaws 140 and 150 are closed by clockwise rotation of outer ring 111, roller 125 engages camming surface 109 on active jaw 104. As outer ring 111 rotates further clockwise, roller 125 rolls further up the inclined surface of camming surface 109 to force the pipe-engaging surface 105 of active jaw 104 into contact with the pipe 15, thus encircling and trapping pipe 15 with and between the active jaw 104 and the side jaws 140, 150 to maintain the side jaws closed (or, if desired, to urge the side jaws further toward the closed position) as the pipe-gripping mechanism 16 is rotated to rotate a pipe 15.

It will be appreciated that when outer ring 111 is rotated in the opposite direction (counterclockwise) as shown in FIG. 13, roller 122 engages camming surface 146 to close side jaw 140 and roller 126 engages camming surface 154 to close side jaw 150. As outer ring 111 rotates further in the counterclockwise direction, roller 122 rides on camming surface 145 and roller 126 rides on camming surface 155 to maintain side jaws 140, 150 closed while roller 124 engages camming surface 108 to urge active jaw 104 into contact with pipe 15. Thus pipe-gripping mechanism 16 may be rotated either clockwise (to make up a joint) or counterclockwise (to break a joint) without reversing the orientation of the tongs or any jaws or other components of the pipe-gripping mechanism. When the outer ring 111 is rotated to the open position illustrated in FIG. 10, springs 147, 157 contract to draw the side jaws outwardly, thereby opening the tong to permit insertion or removal of pipe 15.

It will be appreciated that the pipe-engaging surface of the jaws may be in the form of removeable die inserts or the like as disclosed in U.S. Pat. No. 6,116,118 or any other suitable gripping surface. However, regardless of the particular structure of the dies, inserts or the like, the radial arc of the pipe-engaging surface of jaws 104, 140 and 150 is fixed for any particular configuration. Accordingly, the pipe-engaging surfaces may not be precisely concentric with the external surfaces of the pipe if the pipe is undersized, oversized or non-circular. Therefore, if the pivot point of side jaws 140, 150 is fixed with respect to the pipe 15, the radial arc of the pipe-engaging surfaces of these jaws may not conform to the pipe surface and the gripping forces exerted on the pipe will be unevenly distributed about the circumference of the pipe. Such uneven distribution of gripping forces can, and often does, cause gouging and/or deformation of the pipe.

In order to permit the pipe-engaging surfaces 141, 151 to automatically adjust to the surface of the pipe 15, apertures 143, 153 may be elongated (as shown) to form a slots extending in a less than tangential direction as defined above. Accordingly, as the pipe-engaging surfaces are forced into contact with the pipe by the pressure exerted in camming surfaces 145, 155 by the respective rollers, the pivot ends of side jaws 140, 150 may move in either direction in the less than tangential direction of the slots 143, 153, thereby permitting the pipe-engaging surfaces to adjust to the surface of the pipe and allow the gripping force exerted by each side jaw 140, 150 to be evenly distributed along the arcuate length of the pipe-engaging surfaces 141, 151.

As illustrated in FIGS. 10–13, the side jaws 140, 150, are elongated bodies having first and second ends with side edges extending from and connecting the first and second ends. Arcuate pipe-gripping surfaces 141, 151 are carried on a first side edge thereof disposed toward the second end. An elongated aperture 143, 153 in the first end of the elongated body is journaled about a mounting pin 142, 153 on the inner ring so that the jaw 140, 150 may pivot about the mounting pin 142, 152. However, since aperture 143, 153 is elongated, the second end of the jaw body may move with respect to the mounting pin within the limits of the elongated aperture 143, 153. Accordingly, the arc of the arcuate pipe-gripping surface may be automatically adjusted to be substantially concentric with the outer surface of the pipe 15.

The opposite side edges of the jaws 140, 150 each carry three (3) camming surfaces adapted to be engaged by rollers on the outer ring when the outer ring 111 is rotated with respect to the inner ring 135. The first and second camming surfaces are adapted to engage rollers on the outer ring to close the jaw when the outer ring 111 is rotated clockwise or counterclockwise, respectively, with respect to the inner ring 135. The third camming surface 145, 155 is intermediate the first and second camming surfaces and defines an arc substantially concentric with the arc of the arcuate pipe-engaging surface 141, 151.

As illustrated in FIG. 11 (and shown in phantom in FIGS. 10, 12 and 13) a limit plate 160 is secured to the underside of outer ring 111. Limit plate 160 has a pair of arcuate slots 161, 162. A limit pin (illustrated in FIG. 14 as 116) may be mounted in aperture 163 in inner ring 135 to extend into arcuate slot 161 in limit plate 160. Accordingly, as outer ring 111 rotates clockwise with respect to inner ring 135, the limit pin 116 travels from first end 161A toward opposite end 161B of slot 161. Slot 161 is positioned so that aperture 163 (and thus any limit pin positioned therein) reaches end 161B as roller 125 reaches the desired upper limit of camming surface 109. Thus end 161B limits rotation of the outer ring 111 with respect to the inner ring 135 to the maximum closed position when outer ring 111 is rotated clockwise. When outer ring 111 is rotated counterclockwise to open the pipe-gripping mechanism, aperture 163 (and thus any limit pin therein) moves toward end 161A to limit rotation of the outer ring 111 with respect to inner ring 135 in the counterclockwise direction.

It should be noted that when outer ring 111 is rotated clockwise with respect to inner ring 135, roller 125 moves along cam surface 109, urging active jaw 104 toward pipe 15. In order to limit the maximum squeezing force exerted in pipe 15, the slotted aperture 161 is positioned in limit plate 160 so that pin 116 in aperture 163 reaches end 161B at the point where roller 125 has moved along cam surface 109 to the point where the desired maximum force is exerted. Thus end 161B, in cooperation with pin 116, limits rotation of outer ring 111 with respect to inner ring 135 in the clockwise closing direction.

Although the invention is described and illustrated with a limit pin 116 positioned in an aperture 163 or 164 in the inner ring 135 which projects into an elongated slot 161 or 162 in the limit plate 160 secured to the outer ring, it will be appreciated that other mechanically equivalent arrangements could be employed. For example, the limit pin 116 (or similar apparatus) could be carried on the outer ring and project into slots, notches or the like in the inner ring to accomplish the same results. Such mechanical equivalents will be apparent to those skilled in the art and may be employed without departing from the invention disclosed and claimed herein.

It will also be appreciated that rotation of the inner ring will be restrained by the action of friction band 50 on rim 154. Accordingly, when outer ring 111 is rotated counterclockwise to open the tong, pin 116 contacts the opposite end 161A of arcuate slot 161 to cause inner ring 135 to rotate counterclockwise until aperture 113 is aligned with opening 14 in the frame 10.

For operation of the tong in the break-out direction (counterclockwise rotation), an aperture 164 in inner ring 135 is aligned with a similar elongated slot 162 in limit plate 160. As discussed above with respect to clockwise make-up operation, when limit pin 116 is positioned in aperture 164 extends into slot 162, the ends 162A, 162B of slot 162 limit rotation of the inner ring 135 with respect to the outer ring 111.

It will be appreciated that inner ring 135 is free to rotate 360° with respect to outer ring 111 unless its relative rotation is limited by pin 116 positioned in either aperture 163 or 164 and extending into slot 161 or 162. Ends 161A and 162A define the rotational limits of outer ring 111 with respect to inner ring 135 toward the closed position and ends 161B and 162B define the limits of rotation toward the open position.

The inner ring 135 and outer ring 111 must have an opening to permit pipe 15 to be inserted laterally into the throat of the tong, thus structural rigidity of the outer ring 111 is somewhat weakened in conventional tongs. Since all the gripping force exerted by the gripping mechanism 16 must be countered by the outer ring 111, the weakened outer ring sometimes tends to expand at the opening 113. In accordance with the invention, structural rigidity of outer ring 111 is substantially reinforced by limit plate 160. Since limit plate 160 is secured directly to the outer ring 111, the radial spreading forces exerted on outer ring 111 by gripping mechanism 16 are substantially countered by limit plate 160.

It has been discovered that the pipe 15 sometimes lodges in the throat of the pipe-gripping mechanism 16 and is not readily released from the active jaw 104 after a make-up or break-out operation. To assist in dislodging the pipe 15, a boss or ridge 110 may be formed on the apex of the end of active jaw 104 where camming surfaces 108 and 109 converge.

As illustrated in FIGS. 10 and 11, a knock-out roller 170 may be mounted on outer ring 111 directly opposite opening 113 with its surface aligned to engage boss 110 when the tong is in the full open position shown in FIG. 10. Thus, when the outer ring is rotated to the full open position, knock-out roller 170 engages boss 110 to push active jaw 104 toward the center of pipe 15 and thus dislodge the pipe from the pipe-gripping mechanism.

It will be appreciated that the power tongs illustrated in FIGS. 10–13 may be operated to apply make-up or break-out torque to a pipe (rotate either clockwise or counterclockwise) without removing the tong from the pipe or reconfiguring any major components of the apparatus. It is only necessary to place limit pin 116 in either aperture 163 or aperture 164 to limit rotation of the inner ring 135 with respect to the outer ring 111.

Although the invention has been described with particular reference to chain-driven power tongs, the invention is not so limited. The pipe-gripping mechanism of the invention, as well as any other pipe-gripping mechanism which employs jaws which pivot about a slot elongated in a less than tangential direction, may be used in other tong arrangements (such as gear-driven, etc.) and other pipe-gripping tools.

While only exemplary embodiments of the invention have been illustrated and described in detail herein, it will be readily recognized that the principles of the invention may be used in various forms to provide force-balanced gripping mechanisms for power tongs, back-up tools and other devices of various design for gripping tubular products. It is to be understood, therefore, that even though numerous characteristics and advantages of the invention have been set forth in the foregoing description together with details of the structure and function of the various embodiments, this disclosure is to be considered illustrative only. Various changes and modifications may be made in detail, especially in matters of shape, size, and materials as well as arrangement and combination of parts, without departing from the spirit and scope of the invention as defined by the appended claims.

What is claimed:

1. A power tong comprising:

a frame;

an outer ring rotatably supported on the frame and having a side opening through which pipe may pass to a central position in the tong;

a releasable pipe-gripping mechanism comprising: (i) an inner ring; (ii) an active jaw mounted on said inner ring moveable radially with respect to said inner ring between an open position and a closed position and which has an arcuate-shaped pipe-gripping surface on the first end thereof and first and second camming surfaces on the opposite end thereof, said camming surfaces extending from opposite edges of said opposite end to an apex at the centerline extending from said first end of said active jaw to said opposite end thereof; and (iii) at least one side jaw mounted on said inner ring and pivotal between a closed position and an open position;

means for rotating said outer ring with respect to said frame and said inner ring;

rollers mounted on said outer ring rotatably supporting said inner ring coaxially on the outer ring with at least one of the rollers positioned to engage said first camming surface and move said active jaw toward a closed position when said outer ring is rotated in a first direction, at least one roller positioned to engage said second camming surface when said outer ring is rotated in the opposite direction, and at least one roller positioned to engage said side jaw and pivot said side jaw toward a closed position when said outer ring is rotated with respect to said inner ring; and means for limiting relative rotational movement of said inner ring with respect to said outer ring, wherein said means for limiting relative rotational movement of said inner ring with respect to said outer ring comprises: a member secured to and rotatable with said outer ring having an elongated arcuate aperture therein, the length of said arcuate aperture defining the limits of desired rotational movement of said outer ring with respect to said inner ring; and a limit pin secured to said inner ring and projecting into said elongated arcuate aperture.

2. A power tong as set forth in claim 1 wherein said member secured to and rotatable with said outer ring comprises a plate member having circumferential dimensions substantially corresponding to the circumferential dimensions of said outer ring secured to and rotatable with said outer ring and reinforcing said outer ring against radial expansion.

3. A power tong comprising:

a frame;

an outer ring rotatably supported on the frame and having a side opening through which pipe may pass to a central position in the tong;

a releasable pipe-gripping mechanism comprising: (i) an inner ring; (ii) an active jaw mounted on said inner ring moveable radially with respect to said inner ring between an open position and a closed position and which has an arcuate-shaped pipe-gripping surface on the first end thereof and first and second camming surfaces on the opposite end thereof, said camming surfaces extending from opposite edges of said opposite end to an apex at the centerline extending from said first end of said active jaw to said opposite end thereof; and (iii) at least one side jaw mounted on said inner ring and pivotal between a closed position and an open position, said side jaw including an elongated pipe-gripping element having a pivot end and a free end with an arcuate pipe-gripping surface on one side edge thereof and camming surfaces on the side edge thereof opposite the arcuate pipe-gripping surface; and said side jaw further including an elongated aperture journaled about a mounting pin on said inner ring to permit said arcuate pipe-gripping surface to pivot between an open position and a closed position where said arcuate pipe-gripping surface engages a pipe in said central position in the tong and to permit said pivot end to move with respect to said mounting pin within the limits of said elongated aperture so that the arc of the arcuate pipe-gripping surface is adjusted to be substantially concentric with the outer surface of the pipe;

means for rotating said outer ring with respect to said frame and said inner ring;

rollers mounted on said outer ring rotatably supporting said inner ring coaxially on the outer ring with at least one of the rollers positioned to engage said first camming surface and move said active jaw toward a closed position when said outer ring is rotated in a first direction, at least one roller positioned to engage said second camming surface when said outer ring is rotated in the opposite direction, and at least one roller positioned to engage said side jaw and pivot said side jaw toward a closed position when said outer ring is rotated with respect to said inner ring; and means for limiting relative rotational movement of said inner ring with respect to said outer ring.

4. In a power tong comprising a frame with a side opening to permit entry of pipe to a central position in the tong, an outer ring having a side opening and mounted for rotation on said frame, and an inner ring having a side opening and mounted for rotation on said outer ring, a pivotal jaw comprising:

an elongated body having first and second ends and first and second side edges extending from and connecting said first and second ends;

an arcuate pipe-gripping surface on said first side edge of said elongated body and disposed toward said second end, said arcuate pipe-gripping surface adapted to engage and grip the outer surface of pipe disposed in the central position of the tong;

an elongated aperture in the first end of said pipe-gripping element, said elongated aperture being journaled on a mounting pin carried on said inner ring;

first and second camming surfaces on the second side edge of said elongated body;

rollers mounted on said outer ring and positioned to engage said camming surfaces when said outer ring is rotated with respect to said inner ring; and a third camming surface on the second side edge of said elongated body, said third camming surface defining an arc intermediate said first camming surface and said second camming surface which is substantially concentric with said arcuate pipe-gripping surface on the first side edge of said elongated body.

5. A power tong, comprising:

a frame;

multiple jaws rotatably supported relative to the frame, the jaws being operative to securely grip a pipe received in the frame when the jaws are rotated in a first direction relative to the frame and when the jaws are rotated in a second direction opposite to the first direction relative to the frame, without detaching the jaws from the frame between the rotations in the first and second directions;

an outer ring rotatably supported relative to the frame;

first and second apertures; and a member, the member limiting a gripping force applied by the jaw to the pipe when the outer ring is rotated in the first direction relative to the frame with the member received in the first aperture, and the member limiting the gripping force applied by the jaw to the pipe when the outer ring is rotated in the second direction relative to the frame with the member received in the second aperture.

6. The power tong of claim 5, wherein the multiple jaws comprise first, second and third jaws, wherein the second and third jaws pivot relative to the frame to engage the pipe prior to the third jaw displacing relative to the frame to engage the pipe, and wherein the first, second and third jaws are approximately equally spaced apart when all of the first, second and third jaws engage the pipe.

7. The power tong of claim 5, wherein each of the jaws includes a die configured for contacting and gripping the pipe, and wherein the die is replaceable in the jaw without detaching the jaw from the frame.

8. The power tong of claim 5, wherein the multiple jaws comprise first, second and third jaws which are operative to grip the pipe at locations approximately equally spaced apart about the pipe.

9. The power tong of claim 5, wherein at least one of the jaws is pivotable about a pivot pin received in an elongated aperture.

10. The power tong of claim 9, wherein the aperture is elongated in a less than tangential direction relative to an outer surface of the pipe.

11. A power tong, comprising:

a frame;

first, second and third jaws rotatably supported relative to the frame, the second and third jaws pivoting relative to the frame to engage a pipe received in the frame prior to the third jaw displacing relative to the frame to engage the pipe, and the first, second and third jaws being approximately equally spaced apart when all of the first, second and third jaws engage the pipe;

an outer ring rotatably supported relative to the frame;

first and second apertures; and a member, the member limiting a gripping force applied by the third jaw to the pipe when the outer ring is rotated in the first direction relative to the frame with the member received in the first aperture, and the member limiting the gripping force applied by the third jaw to the pipe when the outer ring is rotated in the second direction relative to the frame with the member received in the second aperture.

12. The power tong of claim 11, wherein the first, second and third jaws are operative to securely grip the pipe when the first, second and third jaws are rotated in a first direction relative to the frame and when the first, second and third jaws are rotated in a second direction opposite to the first direction relative to the frame, without detaching any of the first, second and third jaws from the frame between the rotations in the first and second directions.

13. The power tong of claim 11, wherein each of the first, second and third jaws includes a die configured for contacting and gripping the pipe, and wherein the die is replaceable in each of the first, second and third jaws without detaching the respective jaw from the frame.

14. The power tong of claim 11, wherein at least one of the first, second and third jaws is pivotable about a pivot pin received in an elongated aperture.

15. The power tong of claim 14, wherein the aperture is elongated in a less than tangential direction relative to an outer surface of the pipe.

16. A power tong, comprising:

a frame;

an outer ring rotatably supported relative to the frame;

at least one jaw for gripping a pipe received in the frame;

first and second apertures; and a member, the member limiting a gripping force applied by the jaw to the pipe when the outer ring is rotated in a first direction relative to the frame with the member received in the first aperture, and the member limiting the gripping force applied by the jaw to the pipe when the outer ring is rotated in a second direction opposite to the first direction relative to the frame with the member received in the second aperture.

17. The power tong of claim 16, wherein the jaw includes a die configured for contacting and gripping the pipe, and wherein the die is replaceable in the jaw without detaching the jaw from the frame.

18. The power tong of claim 16, wherein the at least one jaw is multiple jaws rotatably supported relative to the frame, the jaws being operative to securely grip the pipe when the jaws are rotated in a first direction relative to the frame and when the jaws are rotated in a second direction opposite to the first direction relative to the frame, without detaching the jaws from the frame between the rotations in the first and second directions.

19. The power tong of claim 16, wherein the at least one jaw is first, second and third jaws, wherein the second and third jaws pivot relative to the frame to engage the pipe prior to the third jaw displacing relative to the frame to engage the pipe, and wherein the first, second and third jaws are approximately equally spaced apart when all of the first, second and third jaws engage the pipe.

20. The power tong of claim 16, further comprising a plate having the first and second apertures formed therein, and wherein the plate resists outward deformation of the outer ring when the jaw grips the pipe.

21. The power tong of claim 16, wherein the at least one jaw is first, second and third jaws which are operative to grip the pipe at locations approximately equally spaced apart about the pipe.

22. The power tong of claim 16, wherein the jaw is pivotable about a pivot pin received in an elongated aperture.

23. The power tong of claim 22, wherein the aperture is elongated in a less than tangential direction relative to an outer surface of the pipe.

24. A power tong, comprising:

a frame configured for receiving a pipe therein;

first, second and third jaws rotatably supported relative to the frame, the first, second and third jaws being operative to grip the pipe at locations approximately equally spaced apart about the pipe;

an outer ring rotatably supported relative to the frame;

first and second apertures; and a member, the member limiting a gripping force applied by the third jaw to the pipe when the outer ring is rotated in the first direction relative to the frame with the member received in the first aperture, and the member limiting the gripping force applied by the third jaw to the pipe when the outer ring is rotated in the second direction relative to the frame with the member received in the second aperture.

25. The power tong of claim 24, wherein the second and third jaws pivot relative to the frame to engage the pipe prior to the third jaw displacing relative to the frame to engage the pipe.

26. The power tong of claim 24, wherein the first, second and third jaws are operative to securely grip the pipe when the first, second and third jaws are rotated in a first direction relative to the frame and when the first, second and third jaws are rotated in a second direction opposite to the first direction relative to the frame, without detaching any of the first, second and third jaws from the frame between the rotations in the first and second directions.

27. The power tong of claim 24, wherein each of the first, second and third jaws includes a die configured for contacting and gripping the pipe, and wherein the die is replaceable in each of the first, second and third jaws without detaching the respective jaw from the frame.

28. The power tong of claim 24, wherein at least one of the first, second and third jaws is pivotable about a pivot pin received in an elongated aperture.

29. The power tong of claim 28, wherein the aperture is elongated in a less than tangential direction relative to an outer surface of the pipe.

30. A power tong, comprising:

a frame;

at least one jaw rotatably supported relative to the frame for gripping a pipe received in the frame, and the jaw further being pivotable about a pivot pin received in an elongated aperture;

an outer ring rotatably supported relative to the frame;

first and second apertures; and a member, the member limiting a gripping force applied by the jaw to the pipe when the outer ring is rotated in a first direction relative to the frame with the member received in the first aperture, and the member limiting the gripping force applied by the jaw to the pipe when the outer ring is rotated in a second direction opposite to the first direction relative to the frame with the member received in the second aperture.

31. The power tong of claim 30, wherein the aperture is elongated in a less than tangential direction relative to an outer surface of the pipe.

32. The power tong of claim 30, wherein the jaw includes a die configured for contacting and gripping the pipe, and wherein the die is replaceable in the jaw without detaching the jaw from the frame.

33. The power tong of claim 30, wherein the at least one jaw is multiple jaws rotatably supported relative to the frame, the jaws being operative to securely grip the pipe when the jaws are rotated in a first direction relative to the frame and when the jaws are rotated in a second direction opposite to the first direction relative to the frame, without detaching the jaws from the frame between the rotations in the first and second directions.

34. The power tong of claim 30, wherein the at least one jaw is first, second and third jaws, wherein the second and third jaws pivot relative to the frame to engage the pipe prior to the third jaw displacing relative to the frame to engage the pipe, and wherein the first, second and third jaws are approximately equally spaced apart when all of the first, second and third jaws engage the pipe.

35. The power tong of claim 30, wherein the at least one jaw is first, second and third jaws which are operative to grip the pipe at locations approximately equally spaced apart about the pipe.

* * * * *